343-700 MS AU 251 EX
11/19/85 OR 4,554,549

United States Patent [19]
Fassett et al.

[11] Patent Number: 4,554,549
[45] Date of Patent: Nov. 19, 1985

[54] MICROSTRIP ANTENNA WITH CIRCULAR RING

[75] Inventors: Matthew Fassett, Billerica; John F. Toth, Reading; Michael L. Lewis, Arlington; William F. Miccioli, Acton, all of Mass.

[73] Assignee: Raytheon Company, Lexington, Mass.

[21] Appl. No.: 533,836

[22] Filed: Sep. 19, 1983

[51] Int. Cl.[4] ..... H01Q 1/38; H01Q 13/10
[52] U.S. Cl. ..... 343/700 MS; 343/769
[58] Field of Search ..... 343/700 MS, 769, 770, 343/771

[56] References Cited

U.S. PATENT DOCUMENTS 3,665,480 5/1972 Fassett ..... 343/754
4,054,874 10/1977 Oltman, Jr. ..... 343/700

OTHER PUBLICATIONS

"Circular Ring Microstrip Antenna Elements," IEEE-APS International Symposium Digest, pp. 605-608, 1980, by J. W. Mink.
"Characteristics of Microstrip Ring Antennas," IEEE-APS Symposium Digest, vol. I, pp. 27-30, 1981 by I. J. Bahl and S. S. Stuckly.
"Resonant Frequency of a Circular Disc, Printed-Circuit Antenna," vol. AP-25, IEEE Transactions, pp. 595-596, Jul. 1977, by L. C. Shen, S. A. Long, M. R. Allerding & M. D. Walton.
"Conformal Microstrip Antennas and Microstrip Phased Arrays," vol. AP-22, IEEE Transactions, pp. 74-78, Jan. 1974, by R. E. Munson.

*Primary Examiner*—Eli Lieberman
*Attorney, Agent, or Firm*—Philip J. McFarland; Joseph D. Pannone

[57] ABSTRACT

A radar antenna is shown in a first embodiment to have a ground plane and a feed line on opposite sides of a dielectric sheet and a ring-shaped antenna element on another dielectric sheet to form a microstrip assembly wherein such antenna element is capacitively coupled to the feed line. In a second embodiment the radar antenna has a parasitic antenna element on still another dielectric sheet, such parasitic antenna element being in register with the ring-shaped antenna element.

1 Claim, 4 Drawing Figures

MICROSTRIP ANTENNA WITH CIRCULAR RING

BACKGROUND OF THE INVENTION

This invention pertains generally to radar antennas and particularly to radar antennas fabricated using microstrip techniques.

The need for high gain, light weight, and low cost antennas for use in guided missiles (referred to hereinafter as "missiles") has led to the development of antenna elements made using microstrip techniques. Antenna elements so made are easily fabricated and are well adapted to use in missiles. Thus, for example, a microstrip antenna element in the form of a circular disk is described in an article by L. C. Shen, S. A. Long, M. R. Allerding and M. D. Walton entitled "Resonant Frequency of a Circular Disc Printed Circuit Antenna," Vol. AP-25, pages 595–596, July 1977; microstrip antenna elements in the form of rectangular patches are described in an article by R. E. Munson entitled "Conformal Microstrip Antennas and Microstrip Phased Arrays," Vol. AP-22, pages 74–78, January 1974; and microstrip antenna elements in the form of a circular ring are described in an article by J. W. Mink entitled "Circular Ring Microstrip Antenna Elements," IEEE-APS International Symposium Digest, pages 605–608, 1980; or in an article by I. J. Bahl and S. S. Stuckly entitled "Characteristics of Microstrip Ring Antennas," IEEE-APS Symposium Digest, Vol. I, pages 27–30, 1981.

All of the microstrip antenna elements described in the cited articles have co-planar feeds, meaning that the feeds are formed on the same surface as the microstrip antenna elements themselves. It follows, then, that in the design of an antenna using any such elements it is not possible to utilize the entire area of an antenna aperture for the microstrip antenna elements because an appreciable portion of such area must be covered by the feeds.

Microstrip antenna elements reactively coupled to feeds to avoid the shortcomings of co-planar elements and feeds are described in U.S. Pat. No. 4,054,874. The antenna elements are dipoles and the feeds are disposed in the dielectric medium between the dipoles and the ground plane of the microstrip. Circular polarization may be provided by forming orthogonally disposed pairs of dipoles and separately feeding the dipoles in each pair. The bandwidth for either linearly polarized or circularly polarized microstrip antenna elements is, however, rather narrow, thereby counterbalancing any advantage gained from the reactive feed.

SUMMARY OF THE INVENTION

With the foregoing background of the invention in mind, it is therefore a primary object of this invention to provide a wide band, capacitively coupled antenna element made using microstrip techniques.

It is another object of this invention to provide an array of capacitively coupled antenna elements suitable for use in missiles.

The foregoing and other objects of this invention are generally attained in a first embodiment by providing antenna elements in the form of rings printed on a first dielectric sheet with at least one feed line printed on a second dielectric sheet that also supports a ground plane so that when the first and second dielectric sheets are abutted a microstrip antenna is formed wherein the feed line and antenna elements are capacitively coupled.

The shape of the feed line is selected to obtain a desired polarization of the energy from the microstrip antenna. In a second embodiment a third dielectric sheet having rings corresponding to the rings on the first dielectric sheet is provided.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein.

DESCRIPTION OF THE PREFERRED EMBODIMENT

Figure 1:
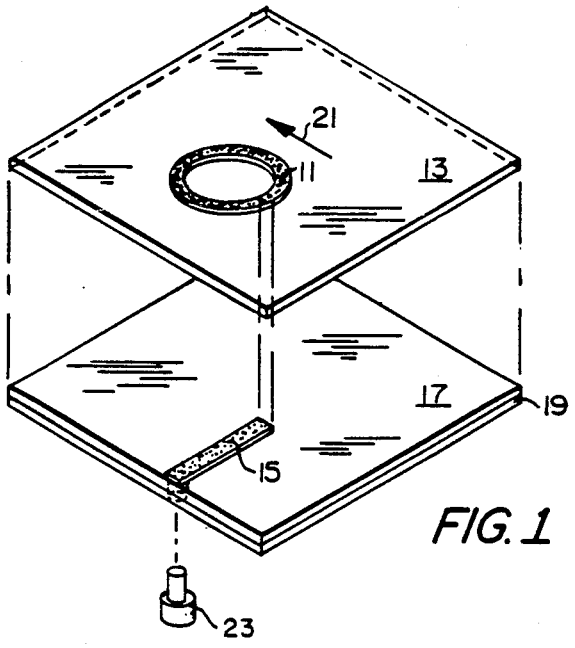
FIG. 1 is an exploded isometric view of a linearly polarized, reactively fed microstrip antenna element according to a first embodiment of this invention.

Before proceeding with a detailed description of the contemplated capacitively fed microstrip antenna, it should be noted that ancillary elements, such as connectors and power divider networks, are not always illustrated, it being deemed obvious that such elements are well known to those of skill in the art and that, in consequence, need not be illustrated for an understanding of the embodiments of this invention. Referring now to FIG. 1, an antenna element 11 is shown to be formed in the shape of a ring (not numbered) as by means of photo-etching on the upper surface of a first dielectric sheet 13, here a sheet of Duroid 5880 material having a relative dielectric constant of 2.21 and a thickness of approximately 0.030 inches. (Duroid 5880 is a dielectric material made by Rogers Corporation, Chandler, Arizona.) The circumference of the ring is equal approximately to one wavelength in the dielectric medium at the frequency of the radio frequency energy desired to be propagated. A feed line 15 for the antenna element 11 is similarly formed on a second dielectric sheet 17 (which is similar to the first dielectric sheet 13 except that a ground plane 19 is formed on the second side of the dielectric sheet 17). The feed line 15 is shown by the broken lines (not numbered) to be terminated in an open circuit directly under one side of the antenna element 11. The polarization sense of the signal generated by the illustrated arrangement is indicated by the arrow 21. To complete the description of FIG. 1, a conventional coaxial cable-to-microstrip connector 23 is mounted in any convenient manner so that the center conductor of a coaxial cable (not numbered) bears on the feed line 15. It will be noted here that the thickness of the dielectric sheets 13 and 17 may be increased to widen the bandwidth of the completed assembly.

Figure 2:
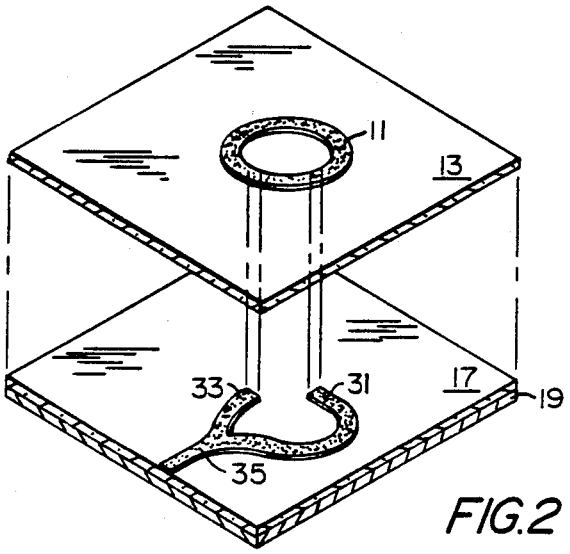
FIG. 2 is an exploded isometric view of a circularly polarized microstrip antenna element according to the first embodiment of this invention.

Referring now to FIG. 2, a circularly polarized antenna element is shown to differ from the linearly polarized antenna element (FIG. 1) only in the manner in which feeding is accomplished. Thus, an antenna element 11 is fed by two feeds 31, 33 oriented 90° with respect to each other. The two feeds 31, 33 in turn are here faired into a common feed line 35. The method of forming the pair of orthogonal feeds 31, 33 from the single feed line 35 is well known to those of skill in the art and will, therefore, not be recounted here. It will be appreciated, however, that in situations where it is desirable to receive both the horizontal and vertical components of a return signal, each of the orthogonal feeds 31, 33 must be separately brought back to a receiver (not shown).

Figure 3:
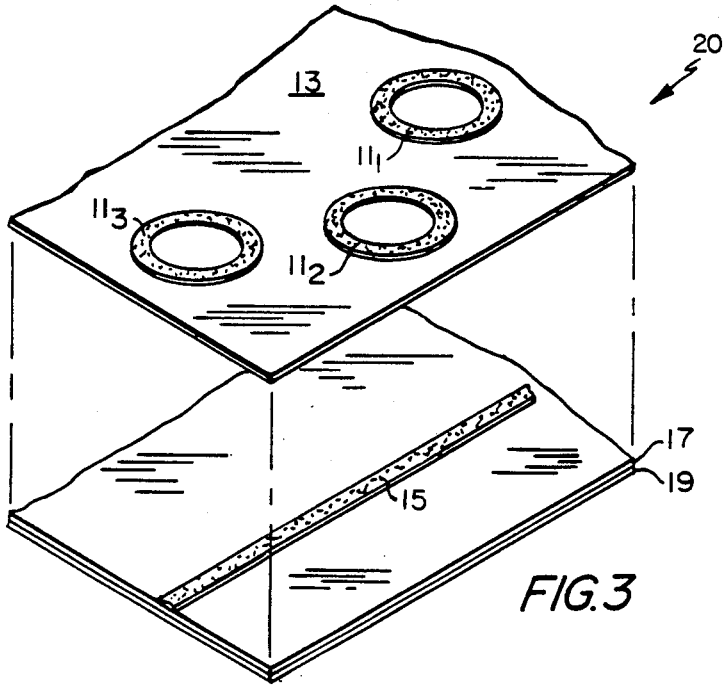
FIG. 3 is a plan view of an array of the microstrip antenna elements of FIG. 1.

Referring now to FIG. 3, an array 20 of antenna elements $\mathbf{11}_1$, $\mathbf{11}_2$, $\mathbf{11}_3$ is disposed on alternate sides of feed line 15 at half wavelength ($\lambda/2$) intervals. The feed line 15 is shown to be terminated in an open circuit at a point below antenna element $\mathbf{11}_1$.

Figure 4:
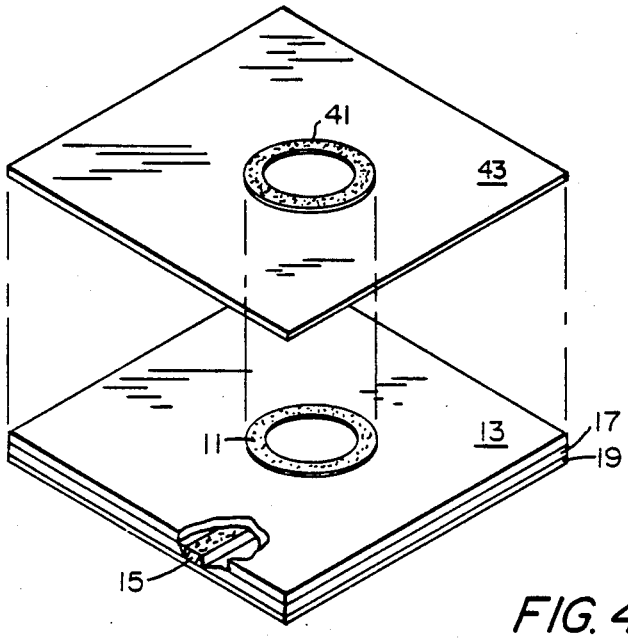
FIG. 4 is an exploded isometric view of a broadband reactively fed microstrip ring resonator according to a second embodiment of this invention.

Referring now to FIG. 4, a parasitic ring 41 is shown disposed on a dielectric sheet 43 overlying the antenna element 11 (FIG. 1). The dielectric sheet 43 is made of Duroid 5880 material having a relative dielectric constant 2.21 and a thickness of approximately 0.030 inches. The dielectric sheet 43 overlying the antenna element 11 effectively lengthens the electrical length of such element, thereby providing a double-tuned response characteristic to the completed assembly so that a significant bandwidth may be attained at X-band. A bandwidth of the same order of magnitude may be obtained at other frequency bands by changing the physical lengths of the antenna element 11 and the parasitic ring 41.

Having described a preferred embodiment of the invention, it will now be apparent to one of skill in the art that other embodiments incorporating its concept may be used. It is felt, therefore, that this invention should not be restricted to the disclosed embodiment, but rather should be limited only by the spirit and scope of the appended claims.

What is claimed is:

1. A radar antenna comprising:

(a) a first and a second dielectric sheet in abutting relationship one to the other;

(b) a ground plane printed on, and covering, the free surface of the first dielectric sheet;

(c) at least one antenna element printed on the free surface of the second dielectric sheet, such antenna element having the shape of a ring, the mean circumference of such ring being equal to one wavelength of radio frequency energy at a desired frequency and in the effective air/dielectric medium;

(d) a feed line printed on an abutting surface of one of the dielectric sheets, such feed line being tangential to the antenna element and being terminated in an open circuit; and (e) means for applying radio frequency energy to the feed line to couple such energy capacitively to the at least one antenna element.

* * * * *